US010267537B2

(12) United States Patent
Johnson, Sr.

(10) Patent No.: US 10,267,537 B2
(45) Date of Patent: Apr. 23, 2019

(54) DUAL ENERGY ELECTRIC AND GAS WATER HEATER WITH IGNITER SHUTOFF CIRCUIT

(71) Applicant: Erskin Johnson, Sr., Shreveport, LA (US)

(72) Inventor: Erskin Johnson, Sr., Shreveport, LA (US)

( * ) Notice: Subject to any disclaimer, the term of this patent is extended or adjusted under 35 U.S.C. 154(b) by 878 days.

(21) Appl. No.: 14/698,888

(22) Filed: Apr. 29, 2015

(65) Prior Publication Data

US 2015/0253038 A1 Sep. 10, 2015

(51) Int. Cl.
*F23Q 3/00* (2006.01)
*F24H 1/18* (2006.01)
*F24H 9/20* (2006.01)

(52) U.S. Cl.
CPC ..... *F24H 9/2007* (2013.01); *F23Q 3/008* (2013.01); *F24H 1/18* (2013.01); *F24H 1/185* (2013.01); *F24H 1/186* (2013.01); *F24H 9/2035* (2013.01); *F24D 2200/32* (2013.01)

(58) Field of Classification Search
CPC ..... F24D 2200/32; F24C 1/02; F24H 1/185; F24H 1/186; F23Q 7/24
See application file for complete search history.

(56) References Cited

U.S. PATENT DOCUMENTS 2,628,597 A 4/1953 Vincent
3,249,303 A 7/1966 Townsend
3,938,946 A * 2/1976 Phlaum ..... F23Q 3/002 431/264
3,986,813 A 10/1976 Erdman
4,070,143 A * 1/1978 Dietz ..... F23N 5/203 431/25
4,165,962 A * 8/1979 Matsumura ..... F23D 14/725 310/325
4,242,078 A * 12/1980 Nelson ..... F23N 5/203 307/66
4,242,079 A 12/1980 Emrich
4,474,139 A 10/1984 Dobias
4,487,030 A * 12/1984 Carter ..... F23N 5/123 431/80
4,518,345 A 5/1985 Mueller
4,740,673 A * 4/1988 Robinson, Jr. ..... F24D 19/1054 219/510
4,981,004 A 1/1991 Weber
5,301,653 A 4/1994 Gerdes
5,575,272 A 11/1996 Byrne
5,722,823 A * 3/1998 Hodgkiss ..... F23N 1/002 126/39 BA
5,960,157 A * 9/1999 McGraw ..... F23N 1/082 392/308
6,474,979 B1 11/2002 Rippelmeyer
(Continued)

*Primary Examiner* — Kenneth Rinehart
*Assistant Examiner* — Deepak A Deean
(74) *Attorney, Agent, or Firm* — Steven L. Fisher-Stawinski

(57) ABSTRACT

A dual energy electric and gas water heater with an igniter shutoff circuit provides the user with a quick connect by which the electrical heating system may be selectively enabled or disabled. A transformer and relay limit the function of the gas igniter to only function when the electrical heating system is not energized, whether by manual disconnection or power loss.

20 Claims, 3 Drawing Sheets

(56) References Cited

U.S. PATENT DOCUMENTS

| | | | | |
|---|---|---|---|---|
| 6,640,047 | B2 * | 10/2003 | Murahashi | F24H 1/18 126/344 |
| 6,882,796 | B2 * | 4/2005 | Ito | F24H 3/04 392/307 |
| 9,416,980 | B2 * | 8/2016 | Yan | F24D 17/0031 |
| 2003/0177818 | A1 | 9/2003 | Bronson | |
| 2004/0220777 | A1 * | 11/2004 | St. Jean | F23Q 7/24 702/185 |
| 2005/0052029 | A1 * | 3/2005 | Aldridge | F02G 1/043 290/2 |
| 2008/0023461 | A1 * | 1/2008 | Anderson | F23Q 7/24 219/260 |
| 2008/0248435 | A1 * | 10/2008 | Clark | F23Q 3/002 431/264 |
| 2013/0266295 | A1 * | 10/2013 | Kreutzman | F24H 9/1818 392/308 |

* cited by examiner

DUAL ENERGY ELECTRIC AND GAS WATER HEATER WITH IGNITER SHUTOFF CIRCUIT

CROSS-REFERENCE TO RELATED APPLICATIONS

Not Applicable

STATEMENT REGARDING FEDERALLY SPONSORED RESEARCH OR DEVELOPMENT

Not Applicable

PARTIES TO A JOINT RESEARCH AGREEMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The invention relates generally to water heaters and in particular to dual energy gas and electric water heaters and to safety circuits therefor. Traditionally, water heaters have been energized by a variety of sources, including electricity and combustion of natural gas, both drawn from local distribution networks. In most populated areas today, residences and other types of facilities including businesses, industrial plants, retail facilities, educational facilities, and government facilities, generally have access to local distribution networks of both electricity and natural gas, and thus the decision on whether to operate water heaters, furnaces, and similar energy intensive equipment is based on current economic conditions affecting the price and immediate availability of electricity and natural gas.

Energy price swings and supply interruptions can occur with little warning, and facilities operators have long sought to maintain dual energy systems that can be switched as necessary, for example, with water heaters that may be energized by either electricity or natural gas. The prior art teaches a number of dual energy water heater systems whose specialized adaptations are focused on rapid, automated, and unattended switching between energy supplies over timescales of seconds up to hours. However, such systems and their attendant management complexity are unnecessary where many homeowners and facility operators want to respond to energy price shifts and supply issues over longer timescales of days up to weeks, and have a more deliberate, manual, and cheaper transition. Such timescales are generally too short and frequent for the regular replacement of a single energy source water heater with another of the other type, but long enough where automated control systems are not necessary.

Dual energy systems in the field of water heaters will necessarily face the problem of disabling the not-in-use energy source when the other is in use, specifically disabling the ability of the system to burn gas while the electric heating system is active and vice versa. The prior art systems have generally addressed this by disabling the gas supply by providing automatic gas flow control. However, the gas igniter generally remains in electrical communication with the ignition point of the gas burner. This creates a potential safety hazard of an unnecessary spark from the unexpected activation of the igniter, even if the gas supply is disabled, whether electronically or manually.

The present invention aims to address these shortcomings of the prior art by providing a dual-energy gas and electric water heater equipped with a safety circuit that disables the gas igniter whenever the electrical heating system is connected to wall power, and where an electrical quick connect is provided for the purpose of easily powering and depowering the electrical heating system. The igniter is intended to be enabled whenever the electrical system is without power, either from being disconnected or from a power outage. The invention may be used in conjunction with manual enablement and disablement of the natural gas supply, or in combination with prior art systems that automatically disable and enable the gas supply.

SUMMARY OF THE INVENTION

Accordingly, the invention is directed to a dual energy electric and gas water heater with an igniter shutoff circuit. The water heater provides the user with a quick connect by which the electrical heating system may be selectively enabled or disabled. A transformer and relay limit the function of the gas igniter to only function when the electrical heating system is not energized, whether by manual disconnection or power loss.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

TABLE 1

CONNECTIONS C1-C14

Figure 1:
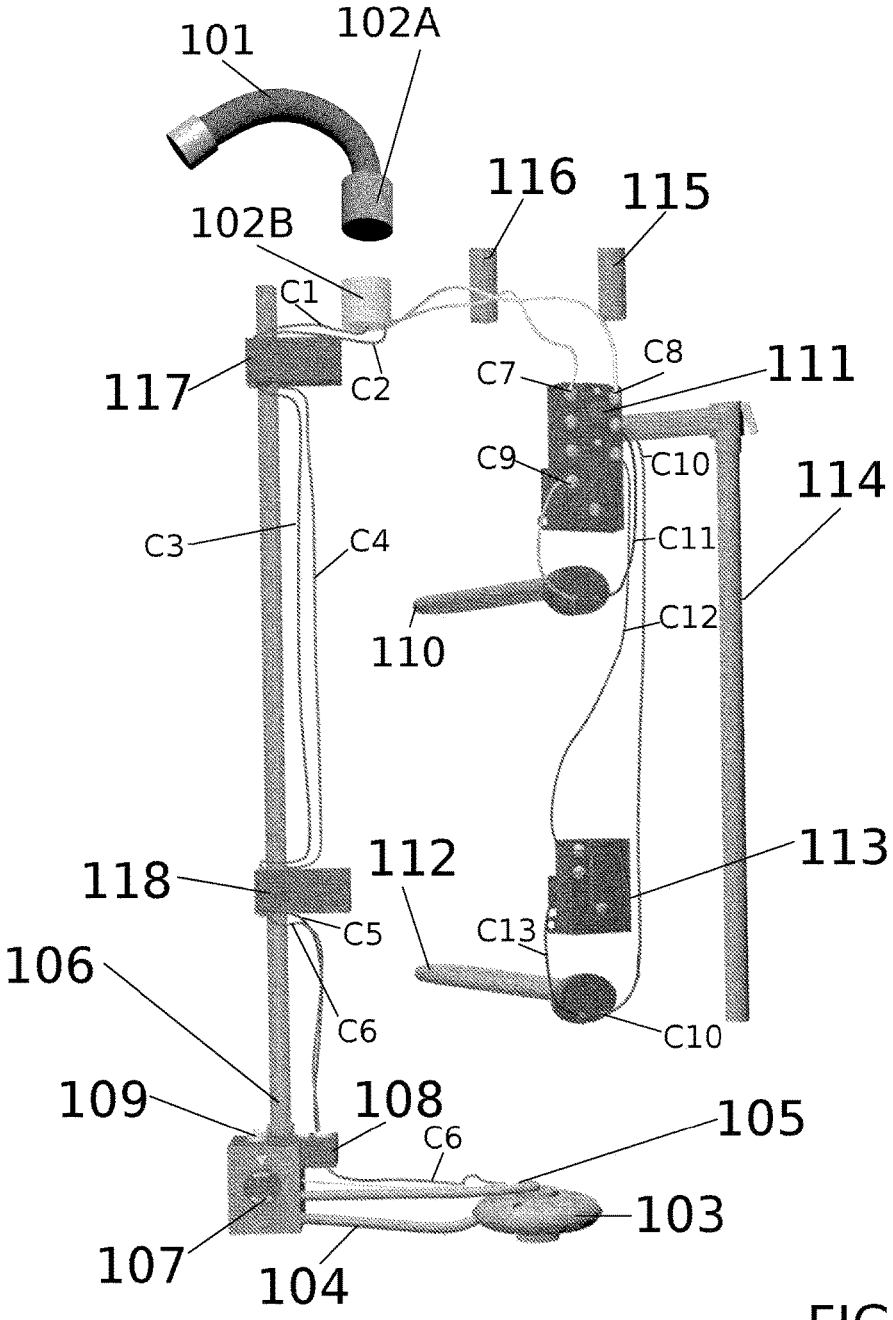
FIG. 1 is a side view of the first exemplary embodiment with the water heater tank not shown, displaying the power lead 101, the quick connect first component 102A, the quick connect second component 102B, the gas burner 103, the gas burner gas line 104, the gas burner ignition electrode 105, the gas supply 106, the gas flow control 107, the igniter 108, the igniter button 109, the upper electric heating element 110, the upper thermostat 111, the lower electrical heating element 112, the lower thermostat 113, the overflow pipe 114, the hot water output 115, the cold water input 116, the transformer 117, the relay 118, and the electrical connections C1, C2, C3, C4, C5, C6, C7, C8, C9, C10, C11, C12, and C13, as shown in TABLE 1.
Figure 2:
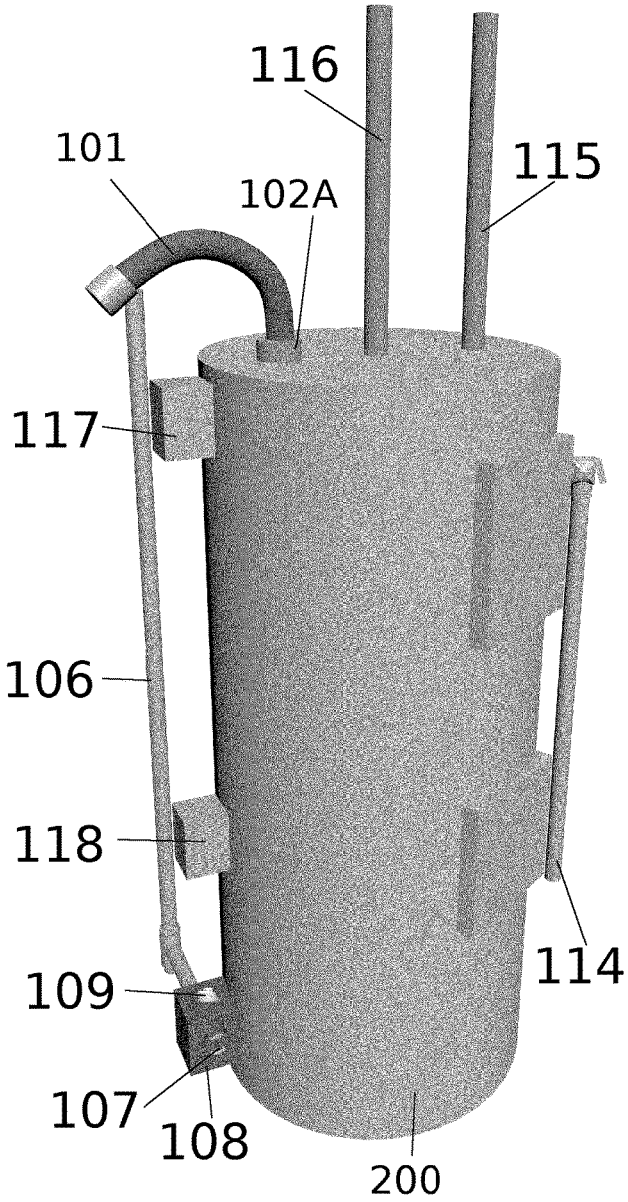
FIG. 2 is a side view of the first exemplary embodiment with the water heater tank and exterior casing shown, displaying the power lead 101, the quick connect first component 102A, the gas supply 106, the gas flow control 107, the igniter 108, the igniter button 109, the overflow pipe 114, the hot water output 115, the cold water input 116, the transformer 117, and the relay 118.

| REF | FROM | | TO | |
|---|---|---|---|---|
| C1 | quick connect second component | 102B | transformer | 117 |
| C2 | transformer | 117 | quick connect second component | 102B |
| C3 | transformer | 117 | relay | 118 |
| C4 | relay | 118 | transformer | 117 |
| C5 | relay | 118 | igniter | 108 |
| C6 | gas burner | 103 | relay | 118 |
| C7 | quick connect second component | 102B | upper thermostat | 111 |
| C8 | upper thermostat | 111 | quick connect second component | 102B |
| C9 | upper thermostat | 111 | upper electric heating element | 110 |
| C10 | lower electrical heating element | 112 | upper thermostat | 111 |
| C11 | upper electric heating element | 110 | upper thermostat | 111 |
| C12 | lower thermostat | 113 | upper thermostat | 111 |
| C13 | upper electric heating element | 110 | lower electrical heating element | 112 |
| C14 | lower electrical heating element | 112 | lower thermostat | 113 |

DETAILED DESCRIPTION OF THE INVENTION

Referring now to the invention in more detail, the invention is directed to a dual energy electric and gas water heater with an igniter shutoff circuit. The water heater 200 provides the user with a quick connect 102A and 102B, by which the electrical heating system may be selectively enabled or disabled. A transformer 117 and relay limit 118 the function of the gas igniter 108 to only function when the electrical heating system is not energized, whether by manual disconnection or power loss.

The water heater 200 itself provides a cylindrical water tank, overflow pipe 114, hot water output 115, and cold water input 116. The gas subsystem, apart from the igniter circuit of the invention, is standard comprising a gas burner 103 supplied with gas from a facility grid or tank via the gas supply 106 and the gas burner gas line 104, and with the gas flow regulated by the gas flow control 107, all standard off-the-shelf components.

Figure 3:
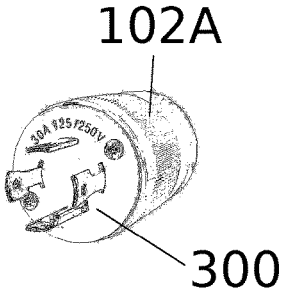
FIG. 3 is a perspective view of the quick connect first component 102A, displaying the quick connect first component 102A and the male NEMA L14 connector 300.
Figure 4:
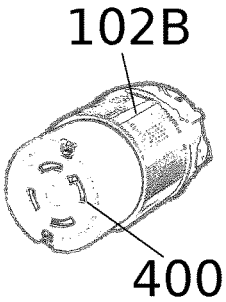
FIG. 4 is a perspective view of the quick connect second component 103B, displaying the quick connect second component 102B and the female NEMA L14 connector 400.
Figure 5:
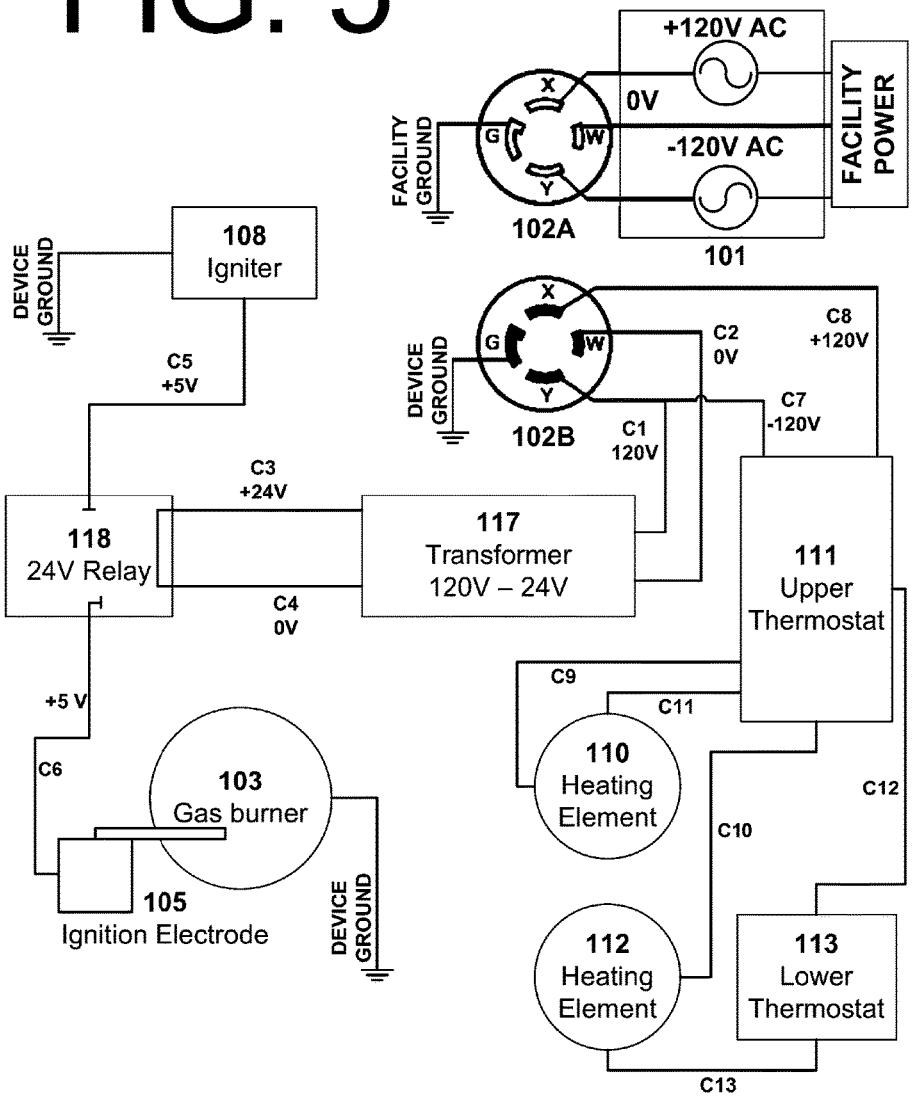
FIG. 5 is a circuit diagram of the electrical components of the first exemplary embodiment, displaying the power lead 101, the quick connect first component 102A, the quick connect second component 102B, the gas burner 103, the gas burner ignition electrode 105, the igniter 108, the upper electric heating element 110, the upper thermostat 111, the lower electrical heating element 112, the lower thermostat 113, the transformer 117, the relay 118, and the electrical connections C1, C2, C3, C4, C5, C6, C7, C8, C9, C10, C11, C12, and C13, as shown in TABLE 1

The power lead 101 is linked to the facility power, preferably and as shown in FIG. 5 with a four-conductor cable including a pair of opposite phase 120V AC sources, a neutral source, and a facility ground. A voltage difference of 240V exists between the opposite phase 120V terminals, and a voltage difference of 120V exists between either of the 120V terminal and the 0V neutral terminal such that either 240V or 120V may be realized within the system. The power lead 101 terminates in a quick connect first component 102A, which is in electrical communication with the power lead 101 and is readily releasable from the quick connect second component 102B. The quick connect components 102A and 102 B may be constructed of off-the-shelf connectors 300 (male) and 400 (female) conforming to the NEMA (National Electrical Manufacturer's Association) L14 standard, for example the L14-R30 connectors shown in FIGS. 3-4. The NEMA L14 connectors 300 and 400 are easily released from and reattached to one another. Alternative connectors may be used, particularly in alternative electrical configurations, depending on locale, though the feature of easy tool-less release and connection whereby electrical communication is broken or created is preferable to the operation of the invention.

Powered via the quick connect second component 102B, and in electrical communication therewith, is the electric heating system, which is comprised of an upper heating element 110, upper thermostat 111, lower heating element 112, and lower thermostat 113. According to well-known designs, the upper thermostat receives a 240V difference between connections C8 at +120V and C7 at −120V in opposite phase. C8 links terminal X on the quick connect second component 102B to the upper thermostat 111, as shown. C7 links terminal Y on the quick connect second component 102B to the Upper Thermostat 111. The upper thermostat provides selective power at 240V AC across connections C9 and C11, which link the upper thermostat 111 to the upper heating element 112. The upper thermostat provides constant power at 240 AC across connections C10 to the lower heating element 112 and C12 to the lower thermostat 113. The lower thermostat provides selectively controls the flow of electricity over connection C13 to the lower heating element 112. The upper and lower thermostats 111 and 113, together with the upper and lower heating elements 110 and 112 together form an electric water heating system that is responsive to water temperature, according to well-known methods and structures.

A gas igniter shutoff circuit is provided. An igniter 108 is configured with a manually actuated igniter button 109. According to well-known structures and principles, pressing the igniter button 109 causes the igniter 108 to be energized, thereby creating a momentary DC voltage across its terminals. In various embodiments, the igniter button 109 is of a type that is configured to convert human-supplied energy from actuation of the button into the momentary voltage; this is in accordance with the circuit diagram of FIG. 5, which shows the igniter 108 as a source of +5V (an exemplary voltage) with no battery or DC adapter from mains electricity. In a standard system, the positive terminal of the igniter would be linked to an ignition electrode located over a gas burner such that pressing the igniter button creates a spark between the ignition electrode and either a secondary electrode or conductive components of the gas burner itself, either of which may be wired to the igniter's negative terminal or to ground (with the igniter's negative terminal linked to ground as well). Generically, and as used in the claims, the ignition electrode 105 is understood to be positioned in proximity to the gas burner 103 such that the gas burner 103 may be ignited by spark emission at the ignition electrode 103, regardless of the exact configuration of the ignition circuit. In the present system of the invention, connection C5 links the igniter 108 to a relay 118, and connection C6 links the relay 118 to the ignition electrode 105, such that the igniter 108 and the ignition electrode 105 are in electrical communication that may be selectively interrupted by the relay 118 being in an energized state. Numerous alternative ignition circuits exist where the interrupt of the relay 118 is differently placed, and all are applicable in the present invention so long as the relay 118's open state prevents a spark from being created at the ignition electrode. The relay 118 is configured to be closed when not energized and open when energized, and is energized by current from a transformer 117 across connections C3 and C4. In the preferred embodiment, the relay 118 is configured to accept 24V and the transformer 117 is configured to output 24V; both DC and AC varieties of off-the-shelf transformers and relays may be used. In the preferred embodiment, the transformer 117 accepts 120V AC input provided across terminals Y and W (or, equivalently, X and W) of the quick connect second component 102B over connections C1 and C2 (or, equivalently, C2 and a connection from terminal X to the transformer 117). Together, the upper and lower thermostats 111 and 113, the upper and lower heating elements 110 and 112, the transformer 117, and the relay 118 form the "electrical heating system" as used in the claims. Generically, the electrical heating system may be said to be energized whenever it is receiving source power on the quick connect second component 102B, and that the relay 118 is understood to be configured so as to be energized whenever the electrical heating system is energized, regardless of the actual configuration of the transformer 117 and connections C3 and C4.

The invention is used according to at least two methods of operation. In the first method of operation, the user wishes to operate the water heater 200 primarily from burning gas; for example, the user may be motivated by the current local price of energy from natural gas relative to the current local price of energy from electricity. In this scenario, the user disconnects or leaves disconnected the quick connect first component 102A from the quick connect second component 102B. The user enables the flow of gas, for example by setting the gas flow control 107 on an on position, or by enabling a main gas valve in-line with the gas supply 106. This has the effect of disabling the electrical heating system and ensuring that connections C3 and C4 through the relay 118 are not energized, and thus the relay 118 will be closed. This will enable operation of the igniter 108 via the manual igniter button 109. The user presses the igniter button, which momentarily applies a voltage on the igniter electrode 105, which sparks to the gas burner 103 (or, equivalently, a secondary electrode) in conjunction with the flow of gas through the gas burner gas line 104, thereby igniting the gas burner 103. Because the electrical systems are disconnected via the quick connect 102A and 102B, there is no risk of double-heating or energy waste resulting from both systems being simultaneously operational.

In the second method of operation, the user wishes to operate the water heater 200 primarily from electricity; for example, the user may be motivated by the current local price of energy from electricity relative to the current local price of energy from natural gas. The user connects the quick connect first component 102A to the quick connect second component 102B, thereby energizing the electrical system (or, in embodiments not having a quick connect, allowing the electrical heating system to be energized). In particular, connections C3 and C4 through the relay 118 will be energized, thereby closing the relay. The closed relay will render the igniter 108 inoperable by electrically isolating connection C5 from connection C6, regardless of user operation of the igniter button 109, and the gas burner cannot receive an ignition spark. The user may then separately disable the supply of gas or leave gas supplied to the system. When gas is allowed to be supplied to the system, the gas system will be enabled automatically in the event of a power failure, because the state of C3 and C4 not being energized will result in the relay 118 closing, thereby enabling operation of the igniter 108 via the igniter button 109.

In alternative configurations, the ignition disabling system of the invention may be combined with existing systems that automatically enable and disable the gas supply in response to the electrical system being energized, thereby providing an additional layer of safety, Components, component sizes, and materials listed above are preferable, but artisans will recognize that alternate components and materials could be selected without altering the scope of the invention.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

I claim:

1. An igniter shutoff circuit for a dual energy electric and gas water heater comprising:

(a) an igniter;

(b) an igniter button, wherein said igniter button is a manually operated pushbutton;

(c) said igniter button being configured to energize said igniter;

(d) a gas burner;

(e) an ignition electrode;

(f) said ignition electrode being proximate to said gas burner such that said gas burner is configured to be ignited by spark emission at said ignition electrode;

(g) a relay;

(h) said igniter and said ignition electrode being in electrical communication that is configured to be selectively interrupted by said relay being energized;

(i) an electrical heating system; and (j) said relay being configured so as to be energized when said electrical heating system is energized, whereby the operability of said igniter and of said electrical heating system is made mutually exclusive; and whereby said igniter is automatically configured to be operable responsive to a power failure.

2. The igniter shutoff circuit for a dual energy water heater of claim 1 further comprising a quick connect first component and a quick connect second component; said quick connect first component and said quick connect second component being capable of being tool-lessly released and reconnected such that electrical communication between said quick connect first component and said quick connect second component is broken or created; a power lead; said power lead being in electrical communication with said quick connect first component; said quick connect second component being in electrical communication with said electrical heating system.

3. The igniter shutoff circuit for a dual energy water heater of claim 1 further comprising a transformer; said transformer being configured so as to accept one hundred twenty volt input and so as to produce twenty four volt output; the output of said transformer being configured so as to energize said relay; said relay being configured so as to accept twenty-four volt input.

4. The igniter shutoff circuit for a dual energy water heater of claim 2 further comprising a transformer; said transformer being configured so as to accept one hundred twenty volt input and so as to produce twenty four volt output; the output of said transformer being configured so as to energize said relay; said relay being configured so as to accept twenty-four volt input.

5. The igniter shutoff circuit for a dual energy water heater of claim 2 wherein said quick connect first component and said quick connect second components are off-the-shelf male and female connectors conforming to the national electrical manufacturer's association 114 standard.

6. The igniter shutoff circuit for a dual energy water heater of claim 4 wherein said quick connect first component and said quick connect second components are off-the-shelf male and female connectors conforming to the national electrical manufacturer's association 114 standard.

7. A method of operation of the igniter shutoff circuit for a dual energy water of claim 2 for operation primarily by electricity comprising allowing said electrical heating system to be energized; allowing said relay to be energized; and allowing said igniter button to be disabled.

8. The method of operation of the igniter shutoff circuit for a dual energy water heater of claim 7 for operation primarily by electricity further comprising, before allowing said electrical heating system to be energized, connecting said quick connect first component to said quick connect second component.

9. The method of operation of the igniter shutoff circuit for a dual energy water of claim 7 for operation primarily by electricity further comprising allowing gas to continue to be supplied; and, in the event of a power failure, allowing said igniter to be enabled and pressing said igniter button, whereby said gas burner is ignited.

10. A method of operation of the igniter shutoff circuit for a dual energy water of claim 4 for operation primarily by electricity comprising allowing said electrical heating system to be energized; allowing said relay to be energized; and allowing said igniter button to be disabled.

11. The method of operation of the igniter shutoff circuit for a dual energy water heater of claim 10 for operation primarily by electricity further comprising, before allowing said electrical heating system to be energized, connecting said quick connect first component to said quick connect second component.

12. The method of operation of the igniter shutoff circuit for a dual energy water of claim 10 for operation primarily by electricity further comprising allowing gas to continue to be supplied; and, in the event of a power failure, allowing said igniter to be enabled and pressing said igniter button, whereby said gas burner is ignited.

13. A method of operation of the igniter shutoff circuit for a dual energy water of claim 6 for operation primarily by electricity comprising allowing said electrical heating system to be energized; allowing said relay to be energized; and allowing said igniter button to be disabled.

14. The method of operation of the igniter shutoff circuit for a dual energy water heater of claim 13 for operation primarily by electricity further comprising, before allowing said electrical heating system to be energized, connecting said quick connect first component to said quick connect second component.

15. The method of operation of the igniter shutoff circuit for a dual energy water of claim 13 for operation primarily by electricity further comprising allowing gas to continue to be supplied; and, in the event of a power failure, allowing said igniter to be enabled and pressing said igniter button, whereby said gas burner is ignited.

16. The method of operation of the igniter shutoff circuit for a dual energy water of claim 14 for operation primarily by electricity further comprising allowing gas to continue to be supplied; and, in the event of a power failure, allowing said igniter to be enabled and pressing said igniter button, whereby said gas burner is ignited.

17. A method of operation of the igniter shutoff circuit for a dual energy water of claim 2 for operation primarily by gas comprising disconnecting or leaving disconnected said quick connect first component from said quick connect second component; enabling the flow of gas to said gas burner; allowing said igniter to be enabled; and pressing the igniter button, whereby said gas burner is ignited.

18. A method of operation of the igniter shutoff circuit for a dual energy water of claim 4 for operation primarily by gas comprising disconnecting or leaving disconnected said quick connect first component from said quick connect second component; enabling the flow of gas to said gas burner; allowing said igniter to be enabled; and pressing the igniter button, whereby said gas burner is ignited.

19. A method of operation of the igniter shutoff circuit for a dual energy water of claim 5 for operation primarily by gas comprising disconnecting or leaving disconnected said quick connect first component from said quick connect second component; enabling the flow of gas to said gas burner; allowing said igniter to be enabled; and pressing the igniter button, whereby said gas burner is ignited.

20. A method of operation of the igniter shutoff circuit for a dual energy water of claim 6 for operation primarily by gas comprising disconnecting or leaving disconnected said quick connect first component from said quick connect second component; enabling the flow of gas to said gas burner; allowing said igniter to be enabled; and pressing the igniter button, whereby said gas burner is ignited.

* * * * *